United States Patent [19]

Sosnove

[11] 3,942,831

[45] *Mar. 9, 1976

[54] REMOVABLE AND DISPOSABLE WASTE COLLECTOR

[76] Inventor: William Sosnove, 3821 Long Beach Blvd., Long Beach, Calif. 90807

[ * ] Notice: The portion of the term of this patent subsequent to Jan. 9, 1989, has been disclaimed.

[22] Filed: Jan. 12, 1970

[21] Appl. No.: 2,318

[52] U.S. Cl. ..... 294/55; 294/1 R; 294/19 R; 15/257.4

[51] Int. Cl.[2] ..... A01B 1/02; A47F 13/08

[58] Field of Search ..... 15/104.8, 257.1, 257.2, 15/257.3, 257.4, 257.5, 257.6, 257.7, 257.8, 257.9; 294/1 R, 55, 19 R

[56] References Cited

UNITED STATES PATENTS

| | | | |
|---|---|---|---|
| 492,455 | 2/1893 | Barnhart | 15/257.1 |
| 608,635 | 8/1898 | Bartholomew | 15/257.9 |
| 741,195 | 10/1903 | Voelker | 294/55 |
| 860,746 | 7/1907 | Hoffman | 294/55 |
| 2,305,950 | 12/1942 | Birch | 294/55 |
| 2,317,688 | 4/1943 | McDonald | 294/55 X |
| 2,699,050 | 1/1955 | MacKay | 294/55 |
| 3,281,178 | 9/1964 | Fisher | 294/1 R |
| 3,286,826 | 11/1966 | Stoll | 206/223 |

FOREIGN PATENTS OR APPLICATIONS

| | | | |
|---|---|---|---|
| 465,932 | 6/1950 | Canada | 294/55 |
| 42,165 | 4/1930 | Denmark | 294/53.5 |
| 544,998 | 5/1942 | United Kingdom | 294/55 |
| 361,534 | 10/1922 | Germany | 257.1/ |

*Primary Examiner*—Daniel Blum
*Attorney, Agent, or Firm*—Sughrue, Rothwell, Mion, Zinn & Macpeak

[57] ABSTRACT

An apparatus for receiving waste products and other debris from a floor, turf and the like, which apparatus is adapted to have a removable plastic bag attached thereto so as to permit selective disposal of said waste products and debris without the possibility of the operator thereof coming in direct contact with such products.

2 Claims, 12 Drawing Figures

INVENTOR.
WILLIAM SOSNOVE

BY Bernard M. Smukler

ATTORNEY

REMOVABLE AND DISPOSABLE WASTE COLLECTOR

This invention relates in general to a portable receptacle adapted to receive and subsequently dispose of various types of waste products and the like, and more particularly to a device which is adapted to gather said waste products in a removable and disposable polyethylene or plastic container or bag thus permitting the said device to remain substantially clean.

DESCRIPTION OF THE PRIOR ART

Various types of receptacles for gathering waste products are well known in the art, particularly those utilized in connection with receiving animal waste. However, they all appear to have an inflexible receiving pan, and none has a disposable and removable bag forming a part thereof of the type as disclosed herein.

OBJECTS OF THE INVENTION

The present invention provides a removable and disposable polyethylene or plastic bag or container connected to the base structure of the invention, and means for removing said bag or container with waste products therein and immediately sealing same.

With the foregoing in mind, it is the primary object of the present invention to provide disposable means which are attached to a receptacle base, which means are adapted to receive therein various types of waste products and to hold same until subsequent sealing and collection. Further and additional objects and advantages of the present invention include having a receptacle device for use in connection with cleaning the waste products of animals from yards, pathways, streets and the like, which device is capable of enclosing said products in a flexible disposable container so that such combination may be removed at any time by the user and sanitarily placed in a trash receptacle for subsequent disposal and; having a waste collecting device as described above which is extremely economical to manufacture and which is simple to operate. Such objects, advantages and capabilities will be readily apparent and better understood from the following description, taken in conjunction with the accompanying drawing.

DESCRIPTION OF THE PREFERRED EMBODIMENT

Figure 1:
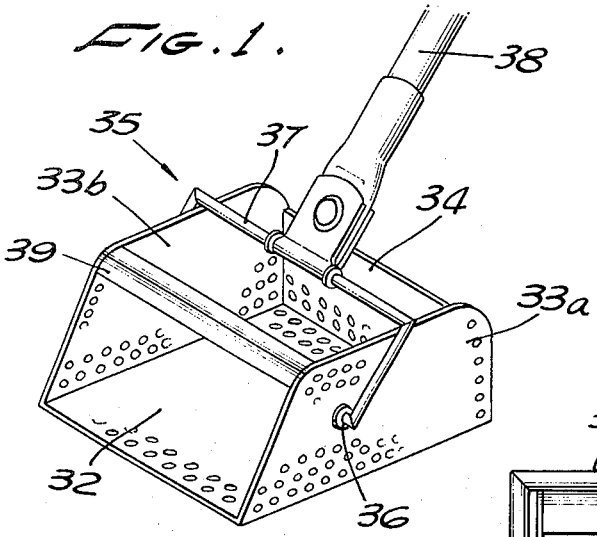
FIG. 1 is a perspective view of the preferred embodiment of the present invention.
Figure 2:
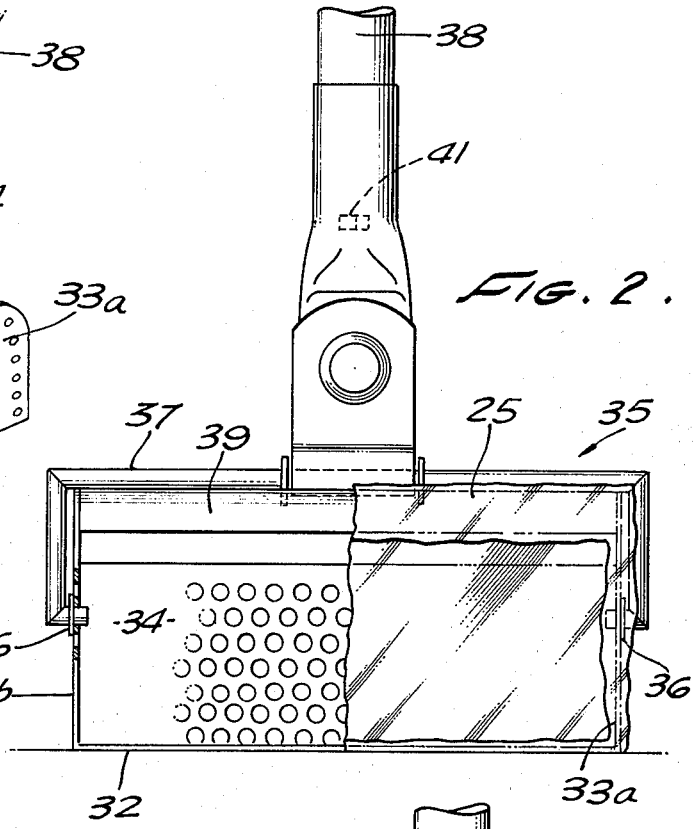
FIG. 2 is a partial cross-sectional front view of said embodiment of the invention.
Figure 4:
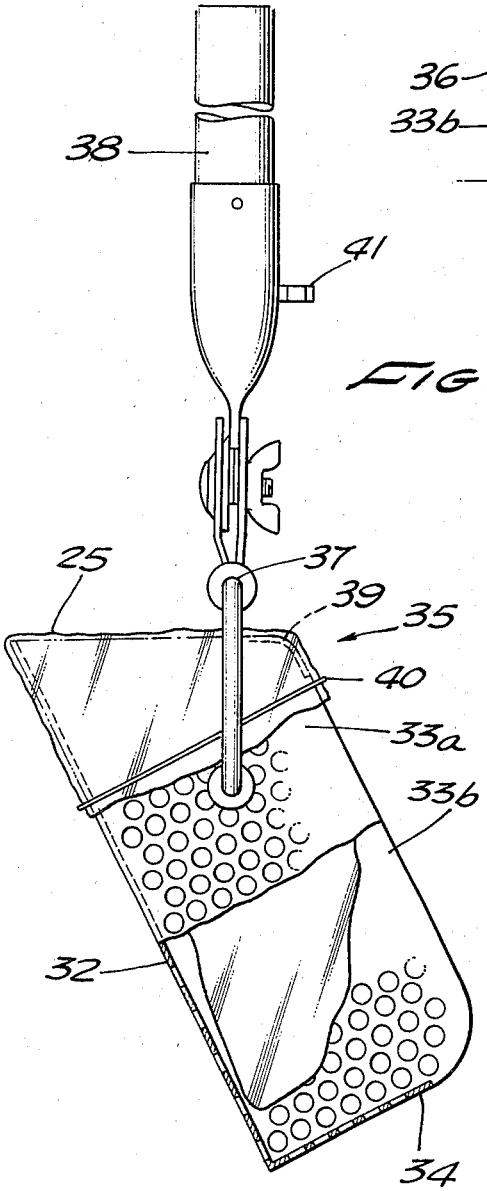
FIG. 4 is a partial cross-sectional side view of the said embodiment, except that it has been lifted upwardly by the handle means therefor.

The presently preferred embodiment of the invention comprises a substantially square shaped floor 32 with the side edges thereof being attached to side portions 33*a* and 33*b* and the rear edge of said floor 32 being attached to back portion 34, all of which may be called pan structure 35. The pan structure 35 is preferably formed of a perforated material, as illustrated in the drawings. The front of said structure 35 is open so as to provide an entry way for collection of various waste products. A circular bracket 36 is provided at each side 33*a* and 33*b* b of said pan structure 35 and said brackets 36 are adapted to revolvingly receive the rein a substantially U-shaped member 37 which is adapted to rotatably hold a handle 38 thereon. In this embodiment of the invention, a bag 25 is placed within the confines of said structure 35, with the opening thereof being coincident with the said substantially rectangularly shaped open front of said pan structure 35. The open edge portion of said bag 25 is folded over connecting bar 39, the leading edges of said side portions 33*a* and 33*b*, and the leading edge of said floor 32, and it is removably affixed thereto by means of a rubber band 40 or the like. As may be appreciated, once waste products are scooped into the interior of said bag 25, the rubber band 40 surrounding said bag 25 and the front opening of said pan structure 35 would be removed. Thereafter, said bag 25 may be removed from said pan structure 35 and closed by use of said rubber band 40. The entire container 25, including the undesirable material therein, may then be discarded into a trash container for subsequent disposal.

Figure 3:
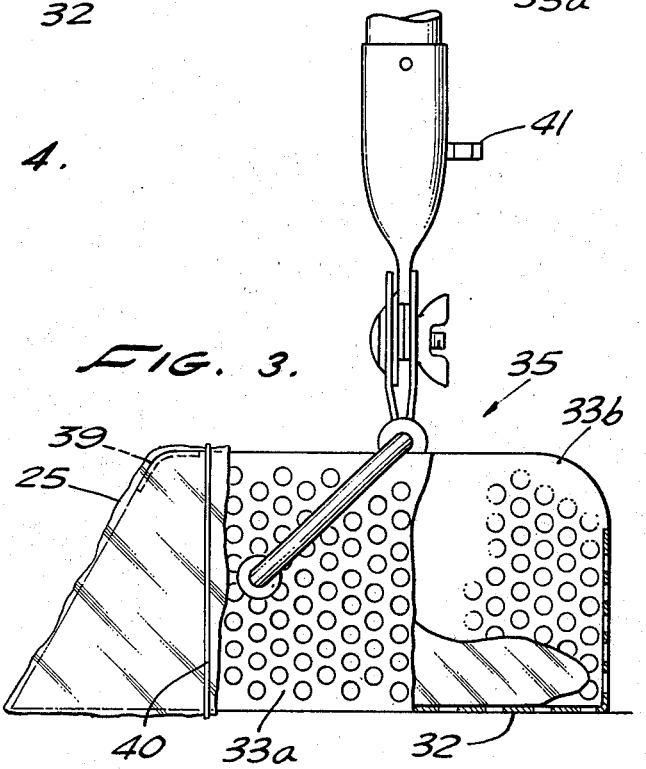
FIG. 3 is a partial cross-sectional side view of said embodiment of the invention.
Figure 5:
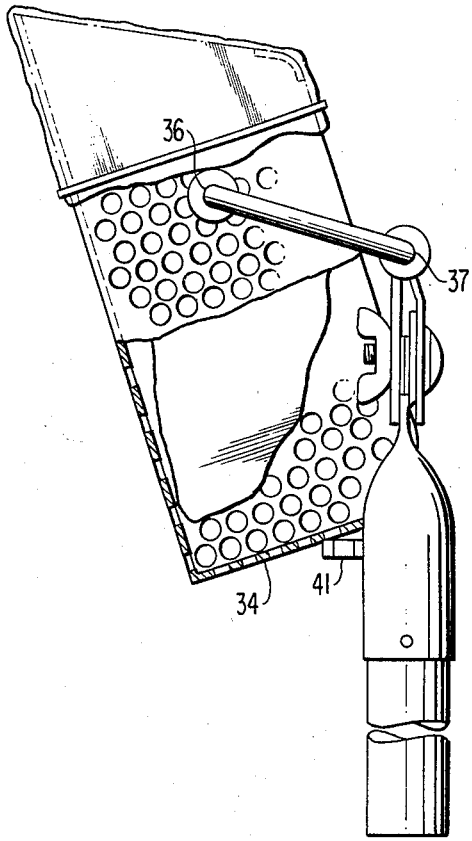
FIG. 5 is a partial cross-sectional side view of said embodiment in position for removal of the disposable container.

A support member 41 is placed on said handle 38 in the position shown in FIG. 3 of the drawing. When it is desired that said bag 25, including the waste products therein, be removed from said pan structure 35, the handle 38 is rotated so that said pan structure 35 is substantially vertical with the open front above the back portion 34. The said back portion 34 may then be positioned so that it rests upon the support member 41 as shown in FIG. 5. Consequently, it becomes very easy to remove said bag 25 in the manner discussed above without fear of physical contact with said products. The present invention is not intended to be restricted to any particular arrangement of parts, or application of any such construction or arrangement of parts, or any specific method of operation or use, since the same may be modified in various particulars or relations without departing from the spirit and scope of the claimed invention hereinabove shown and described. For that reason, the embodiment disclosed herein is intended only for illustration and for disclosure of an operative embodiment and not to show all of the various forms or modifications in which the invention might otherwise be embodied.

I claim:

1. A portable apparatus for collecting waste products and various debris therein, said apparatus comprising:

a. a generally rectangularly shaped open pan having a flat bottom portion, side portions, and a rear portion;

b. bar means for fixedly connecting the side portions of said pan at the front thereof so as to define a substantially planar open front end;

c. a substantially U-shaped member each leg of which is rotatably mounted on the outside of one of the side portions of said pan;

d. a handle rotatably mounted on the portion of said substantially U-shaped member joining the legs thereof;

e. a flexible and disposable container adapted to be inserted within the confines of said pan with the opening thereof folded back over the front edges of the bottom portion and side portions of said pan and the front edge of said bar means;

f. elastic band means for removably connecting the portion of said container folded over said pan and said bar means to said pan and said bar means, thereby providing a planar passageway into the interior of said container; and g. a support member mounted on said handle in a position such that, when said handle is rotated so that said pan is substantially vertical with the open front above the rear portion of said pan, the rear portion of said pan rests upon said support member, thereby facilitating the removal of said disposable container without physical contact with waste products or debris contained therein.

2. A portable apparatus for collecting waste products and various debris therein as recited in claim 1 wherein said pan is formed of a perforated material.

* * * * *